United States Patent [19]

Wuetig

[11] Patent Number: 4,815,520

[45] Date of Patent: Mar. 28, 1989

[54] METHOD AND APPARATUS FOR CONTINUOUSLY CASTING METAL

[76] Inventor: Fred H. Wuetig, 7445 S. Chicago Ave., Chicago, Ill. 60619

[21] Appl. No.: 425,335

[22] Filed: Sep. 28, 1982

Related U.S. Application Data

[63] Continuation of Ser. No. 200,936, Oct. 27, 1980, abandoned.

[51] Int. Cl.[4] ..... B22D 11/12

[52] U.S. Cl. ..... 164/476; 72/225; 164/417; 164/424; 164/477

[58] Field of Search ..... 164/76.1, 417, 424, 164/476, 477; 72/224, 225

[56] References Cited

U.S. PATENT DOCUMENTS

| | | | |
|---|---|---|---|
| 2,947,075 | 8/1960 | Schneckenburger et al. | 164/76.1 |
| 3,483,915 | 12/1969 | Schneckenburger et al. | 164/76.1 |
| 3,837,391 | 9/1974 | Rossi | 164/424 |
| 4,204,417 | 5/1980 | McVoy,Jr. | 72/224 X |

FOREIGN PATENT DOCUMENTS

| | | | |
|---|---|---|---|
| 51-74931 | 6/1976 | Japan | 164/418 |
| 51-90932 | 8/1976 | Japan | 164/424 |
| 55-117505 | 9/1980 | Japan | 164/448 |
| 1174849 | 12/1969 | United Kingdom | 164/476 |

*Primary Examiner*—Nicholas F. Godici
*Assistant Examiner*—J. Reed Batten, Jr.
*Attorney, Agent, or Firm*—Keith Schoff

[57] ABSTRACT

Continuous casting of metal is optimumly practiced by pouring a casting configured with a trapezoidal cross-section, which issues from the bottom of a mold curvilinearly directed to horizontal extension where it is passed between vertically aligned squeeze rolls which compressively deform and narrow the cross-sectional configuration from trapezoidal to rectilinear and thereby straighten and true the casting for being pinched-off and sectioned to length while the core of the casting is molten. The inventive method and means avoids tensilely stressing the casting, lessening the risk that the skin of the casting will rupture from being stretched and that molten metal from the core of the casting will spill endangering personnel and equipment and ruining the casting.

6 Claims, 3 Drawing Sheets

FIG. 5
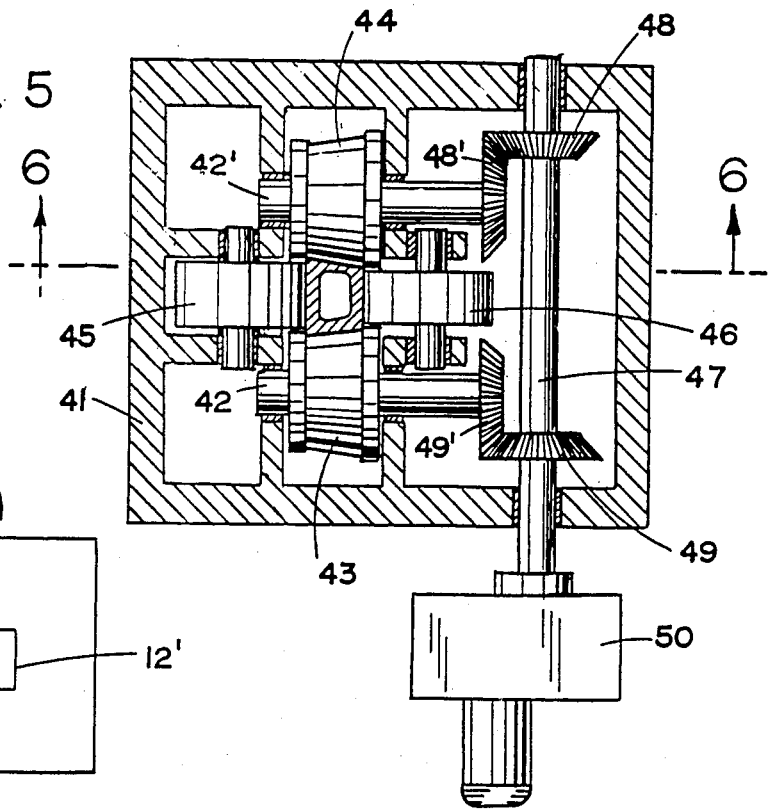
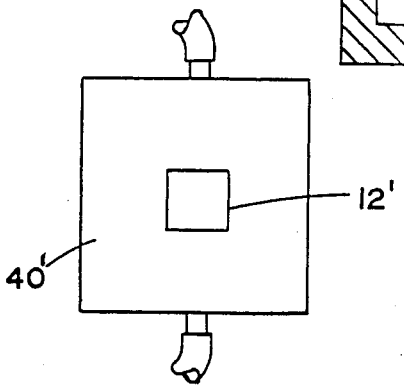
FIG. 4
FIG. 6
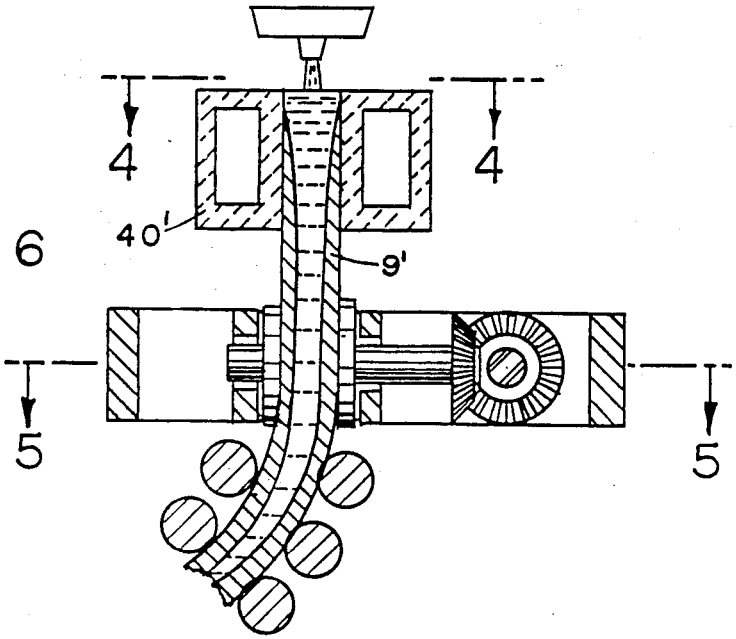

METHOD AND APPARATUS FOR CONTINUOUSLY CASTING METAL

BACKGROUND OF INVENTION

Continuous metal casting is conventionally practiced utilizing a furnace, ladle or tundish to continuously charge molten metal to a water jacketed mold. A thin layer of the molten metal which contacts the chilled surface of the mold solidifies and forms a thin walled casting with a molten core which continuously issues from the bottom of the mold onto a supporting apron set with rollers to bend and direct the casting along a curved path through cooling water sprays. At the point of horizontal tangency to the curved arc of the casting, a second set of bending rolls straightens the casting for travel along a run-out table where the casting is further cooled and is flame cut to desired lengths. In passing through the bending and straightening rolls, the casting is tensilely stressed and the skin is stretched;in order to minimize the danger of rupturing the skin of the casting and to avoid spills of molten metal, the radius of curvature of the arc through which the casting is bent is made relatively large and the elevation of the mold above the work floor relatively great compared to that which would otherwise be employed if the casting were not stretched by being bent.

U.S. Pats. Nos. 3,447,591, 3,837,391, and 3,780,552 show continuous casting apparatus equipped with roller pairs contacting, respectively, only the inner and outer peripheral faces of a curved casting; only the radial faces of such a casting; and only non-parallel faces of a casting with a trapezoidally configured cross-section. Nothing in the prior art shows means which alter the cross-sectional configuration of a casting to effect change in axial linearity nor does any prior art show means for bending a casting without tensilely stressing and stretching it.

SUMMARY OF THE DISCLOSURE

A continuous casting mold is configured with a curvilinear cavity of trapezoidal cross-section which is radiused to a pivot axis about which the mold is oscillated. At the point of horizontal tangency to the arc of the casting, a pair of pinch rollers set on vertical axes squeeze the non-parallel side faces of the casting causing the inner, broader peripheral face to be narrowed and simultaneously elongated to conform in dimension to the outer peripheral face and thereby straighten the casting without tensilely stressing it. The continuous casting is pinched-off to desired lengths while the core is molten thereby obviating the need to flame cut the casting. A relatively short radius of casting curvature may be provided and low elevation of the mold is possible because of the absence of bending stresses being imposed on the casting which tend to tensilely stress it and risk rupture of the solidified skin on the casting.

An inventive embodiment which is suitable for use with existing continuous casting molds provides pinch rolls for shaping a casting into one having a trapezoidal cross section, the rolls being disposed adjacent the mold discharge. In a manner analogous to straightening anarced casting by passing it between parallel vertical rolls, non-parallel horizontally set rolls may be placed below a mold to simultaneously narrow and elongate by compression one face of the casting to provide an outer peripheral face of narrower and longer dimension than the undisturbed opposite face which constitutes the inner peripheral face.

BRIEF DESCRIPTION OF THE DRAWINGS

FIG. 4 is a plan view of the top of a straight cavity oscillating mold taken along line 4—4 in FIG. 6;

FIG. 5 is a sectional plan view of the embodiment of FIG. 4 showing squeeze rolls disposed below the discharge opening of the mold for re-forming the cross section of the casting and rendering the casting curvilinear and is taken along line 5—5 in FIG. 6;

FIG. 6 is an elevation in partial section of the embodiment of FIGS. 4 and 5 taken along line 6—6 in FIG. 5;

DESCRIPTION OF THE INVENTION

Figure 1:
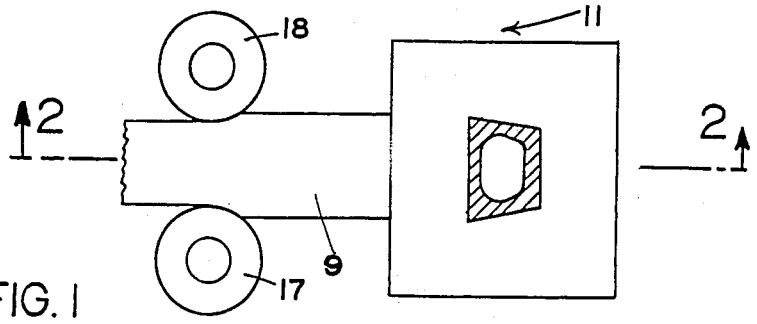
FIG. 1 is a plan view in partial section of one embodiment of the invention taken along line 1—1 of FIG. 2.
Figure 2:
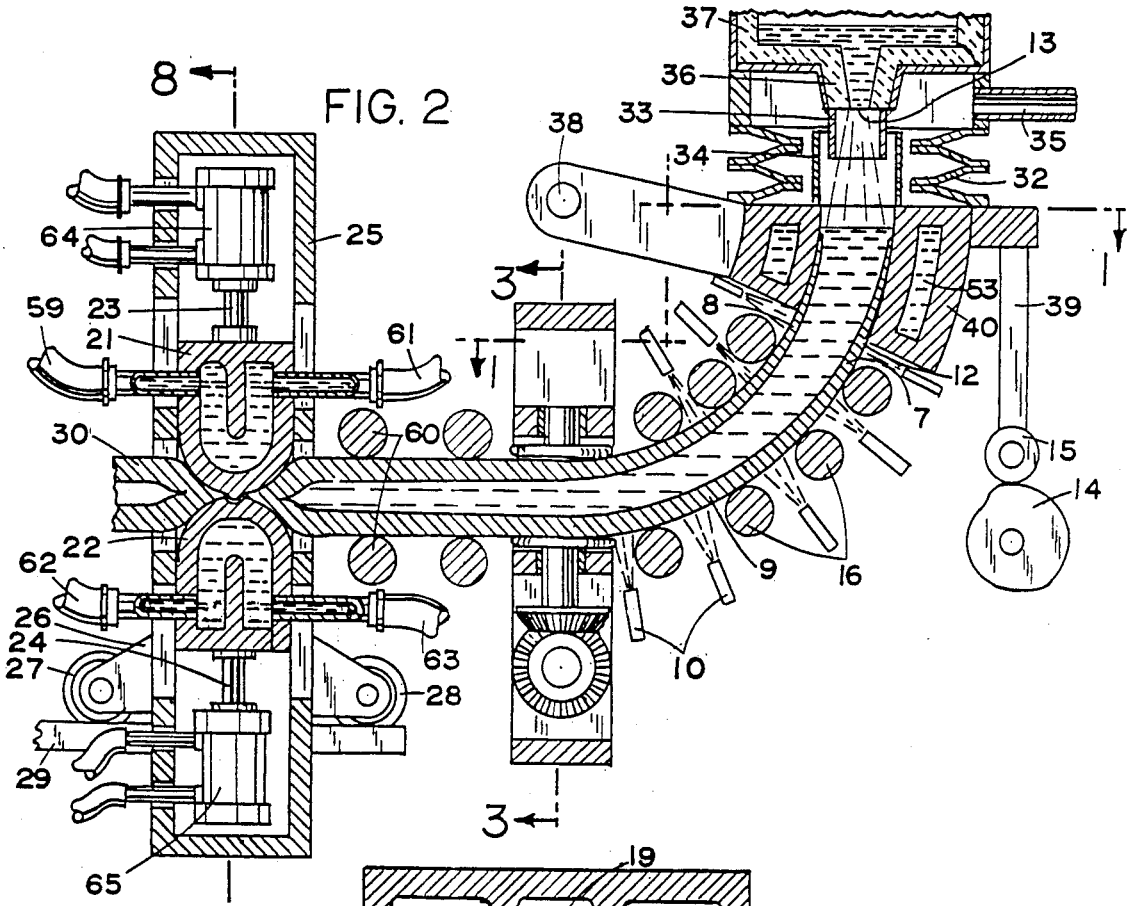
FIG. 2 is a side elevation in cross-section taken along line 2—2 in FIG. 1.
Figure 3:
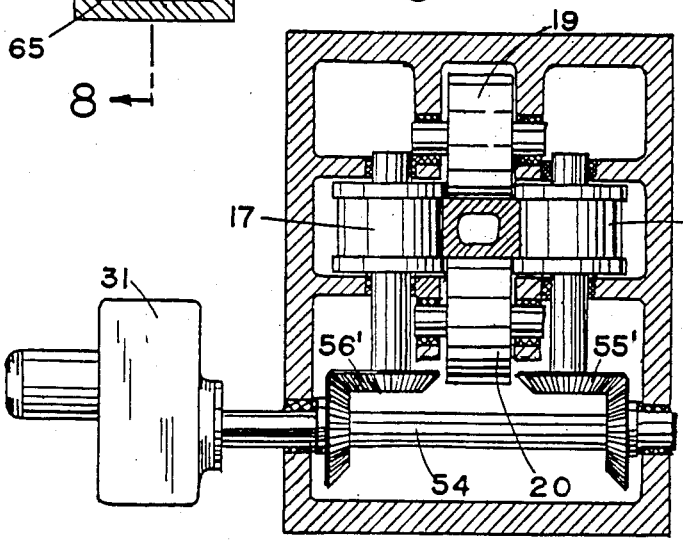
FIG. 3 is an end elevation in cross-section taken along line 3—3 in FIG. 2.

The embodiment of the invention depicted in FIGS. 1, 2, 7, 8 shows the casting of a billet in a curved mold with the inner peripheral face of the billet being wider than the outer peripheral face to provide the billet with a trapezoidal cross sectional configuration as cast whereas the embodiment of the invention shown in FIGS. 4, 5 and 6 is suitable for being retro-fitted to existing casting molds of rectilinear crosssection and vertically linear alignment. Referring to FIGS. 1, 2 and 3, casting machine 11 comprises curved water jacketed mold 40, cavity 12, pouring spout 13, cam 14 and follower 15 mounted and powered to oscillate the mold, and guide rollers 16, as conventional components for which no invention is claimed. Cylindrically configured squeeze rollers 17 and 18 compress the inner arcuate face 8 of cast billet 9 to a width substantially equal to that of outer arcuate facet thereby simultaneously elongating face 8 and compressively sealing the two faces of the casting. The relationship of the configuration of billet 9 is such that the width of the billet cross section is greater on the inside of the arc than it is on the outside in an amount that relates to the radius of curvature of the billet such as to render the two faces of substantially equal area for a given angular sector will result, and that correspondingly when the two faces are equalized in width by passing billet 9 between rollers 17 and 18, the faces become equal in length also with the result that the billet is straightened. Shaping and straightening of a billet is accomplished, using the method and means of this invention, entirely by compressive force and without tensilely stressing the solidified skin portion of the billet thereby firming, strengthening and sealing the facings of the billet rather than stretching and fissuring them in the manner of conventional bending rolls. In the absence of stretching forces being imposed on billet 9 during straightening, the radius of curvature of the billet may be substantially less than is required when bending rolls are used to shape or straighten a billet and the elevation of the casting machine above the floor may be lower than is required in conventional practice. The shorter travel path for billet 9 than for conventional castings which issue from conventional horizontal discharge molds results in less cooling of the casting before it is straightened and a thinner solidified outer layer or 'skin' on the casting when it is straightened than conventionally is the case, and requires less energy utilization to straighten the billet than is required when a greater portion of the billet cross-section is solidified. Rollers 19 and 20 are provided as flattening rollers to prevent bulging of the side faces of billet 9 as it is straightened and insure that the billet is of true rectilinear section Molten metal flowing from discharge spout 13 falls by gravity through an evacuated space into mold cavity 12, being de-gassed by the passage. Bellows 32 flexibly connects skirt 36 depending from tundish 37 to the upper surface of mold 40. Vacuum line 35 communicates the environment between the pouring spout and the mold with a vacuum pump or ejector, not shown, to provide sub-atmospheric pressure within the bellows and to remove gases and vapors which escape from the molten metal. A pair of cylindrical sleeves 33 and 34 are annularly spaced to enable gas to readily flow to vacuum line 35, but prevent spatter from the molten metal from reaching the bellows so as to prevent damage.

Mold 40 is pivotally mounted by shaft 38 for being oscillated by means of cam 14 driven by motor means not shown, cam follower 15 and connecting arm 39, to move arcuately downward substantially at the speed at which billet 9 is fed through rollers 17, 18, 19 and 20, the billet being supported along the arc of travel by apron rollers 16 and being cooled during its travel by water sprays 10 On the upswing of mold 40 billet 9 continues at uniform speed in its downward course and is withdrawn from the mold exposing the chilled mold surface at the upper portion of the mold cavity to molten metal to cause the creation of a continuation in the formation of a solidified 'skin' on the casting in the mold. Cooling water 53 is circulated through mold 40 by means of pumps and flexible connecting hoses, not shown.

Electric motor 31 through means of shaft 54 and bevel gear sets 56', 55" drive rollers 17 and 18, respectively, at constant speed to establish the speed of travel of billet 9. The straightened billet passes between rollers 60 which guide it for being laterally squeezed and narrowed by hydraulic powered side rams 72, 73 (FIG. 7,8) which are mounted by carriage 26 together with pinch-off rams 21, 22 for traveling with billet 9 in a horizontal path while a length of the billet such as section 30 is being severed by the rams pinching the billet to spart it and seal the severed end agasinst loss of molten core metal. The pinched-off end of the billet thus produced is somewhat pointed, facilitating entering of the billet section into the mill rolls during further processing to finished shape. Cooling water is supplied to pinch-off rams 21 and 22 by means of flexible coolant water hoses 59, 61 and 62, 63, respectively, and the rams are actuated to open and close against one another by hydraulic cylinder 64 and piston rod 23 being provided in operable connection to ram 21, and by hydraulic cylinder 65 and piston rod 24being similarly coupled to ram 22. Hydraulic pump means and prime movers are not shown in connection with rams 21 and 22, nor is motive means shown for driving carriage 26, nor is connection with cylinders 70, 71 for actuating rams 72,73 respectively, such means being conventional. Carriage 26 is provided with flanged wheels 27, 28 for operably traversing track 29 either by being operable driven by motor means or by moving under urging of billet 9 when pinch rams 21 and 22 are in contact therewith. Return movement after the billet is severed may either be by means of motor reversal to the drive means or by return spring or counterweight biasing, or other operable means. The entire assembely of rams and actuating means is mounted by frame 25 which is supported on carriage 26. As shown in FIG. 2, the two pinch-off rams 21 and 22 are configured one with a protruding ridge and the other with a groove at the contact line between the two for the purpose of enabling the stretched billet to be totally severed by tearing of the stretched skin of the billet at the contact line between the rams, while the generally blunt nose configurations of the rams press the skin facings of the billet together into a pressure weld.

In FIG. 4 water cooled mold 40' is shown with cavity 12' of square crosssection and is axially linear as shown in FIG. 6. Forming rollers 43, 44 (FIG. 5) of substantially conical configuration are disposed immediately below mold 40' for reshaping billet 9' into trapezoidal cross-sectional configuration similar to that of billet 9 of FIG. 1. Electric motor and integral gear box 50 powers shaft 47 on which bevel gears 48 and 49 are mounted and operably meshed with gears 48' and 49', respectively. Shafts 42 and 42' operably mount both gear roller 43 and gear 49' on one shaft and gear 48' and roller 44 on the other. Rollers 45 and 46 are operably mounted to bear against adjacent opposite faces of billet 9' from those which are contacted by rollers 43 and 44 and are so placed to enable the billet to be bent into curvilinear configuration immediately below the elevation where rollers 45 and 46 contact the billet. The apparatus for straightening and shearing the billet below frame 41 on which the rollers and drive mechanism are mounted is similar to that shown in FIGS. 2 and 3.

Figure 7:
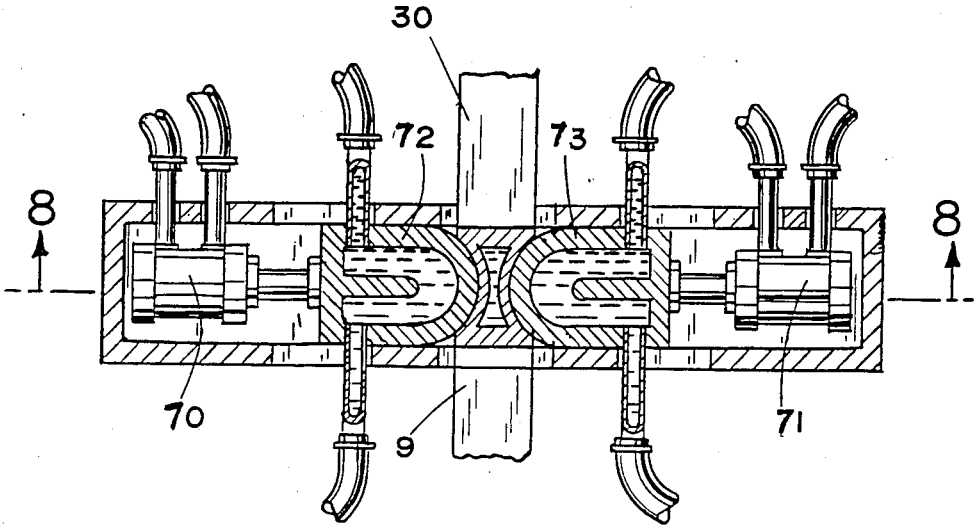
FIG. 7 is a cross-sectional plan view of the embodiment of FIG. 2 taken along line 7—7 of FIG. 8.
Figure 8:
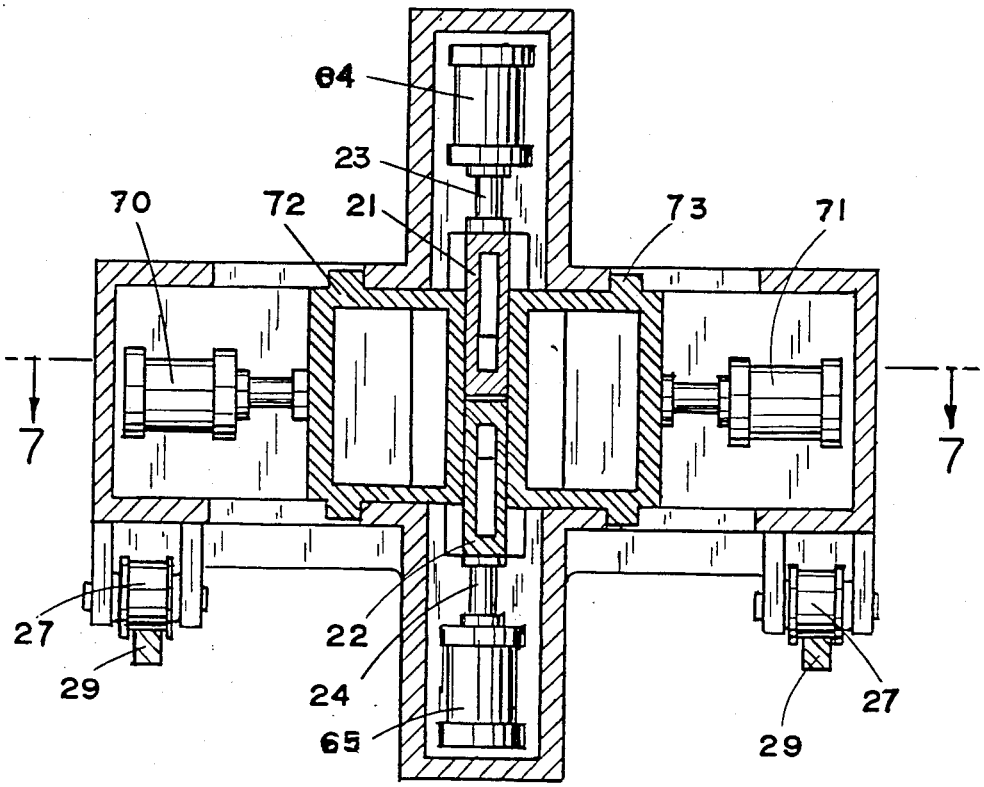
FIG. 8 is a cross-sectional elevation of the embodiment of FIG. 2 taken along lines 8—8 of FIGS. 2 and 7.

In FIGS. 7 and 8 are shown cross-sectional views of rams 72, 73 which are biased laterally to compress and narrow billet 9 and form a vertical channel in which pinch-off rams 21, 22 are biased to section the billet and seal the sectioned ends against leakage of the molten core by compressing the walls of the billet together to effect a fused, pointed end.

I claim:

1. In continuous metal casting apparatus embodying a mold having a top opening cavity and bottom discharge through which a continuous casting with solidified surface layer and molten core is withdrawn, an improvement comprising (a) means providing a trapezoidally configured cross-section and arcuate length to a continuous casting, wherein the circumferential faces of said arcuate length of said casting are disposed as parallel sides of said trapezoidally configured cross-section with the innermost of said circumferential faces being the wider, (b) means to compressively contact a casting configured with a trapezoidally shaped cross-section and arcuate length for compressively narrowing and deforming the cross-sectional configuration and lengthening at least a portion of the surface of the casting in longitudinal dimension substantially to at least that of the outermost of said circumferential faces thereby to straighten and true the casting maintained with a molten core comprising at least one pair of squeeze rollers disposed with axes substantially radial to the arcuate configuration of said casting and at least one further pair of rollers disposed axially transverse to said squeeze rollers and substantially planar therewith for contacting the parallel faces of said trapezoidally configured cross-sectional casting wherein frictional contact with said casting in a substantially radial plane thereto causes all said rollers to rotate at uniform surface speed substantially equal to the velocity of travel of said outermost circumferential face of said casting.

2. The apparatus of claim 1 wherein said means providing a trapezoidally configured cross-section and arcuate length to a continuous casting comprises a mold having a trapezoidally configured discharge opening.

3. The apparatus of claim 2 wherein said mold comprises a cavity which is axially curvilinear.

4. The apparatus of claim 3 wherein said mold is pivotally mounted for being oscillated about the axis of curvature of said cavity.

5. The apparatus of claim 1 wherein said means providing a trapezoidally configured cross-section and arcuate length to a continuous casting comprises at least one pair of squeeze rollers.

6. The method of altering the linearity of a metal casting while maintaining it with a molten core wherein said casting is configured with a trapezoidal cross-section and arcuate length comprising the steps of providing a set of squeeze rollers for contacting opposite non-parallel faces of a continuous casting of said trapezoidal cross-section, passing said casting while it is maintained with a molten core between said squeeze rollers in contact with said casting to compressively deform said casting to differentially elongate surface portions of said casting substantially to at least the length of the narrower of the parallel trapezoidal cross-sectional faces and alter the linearity of the casting without tensilely stressing the casting while throughout it is maintained with a molten core.

* * * * *